United States Patent [19]

Connors et al.

[11] 4,194,312

[45] Mar. 25, 1980

[54] NEEDLEPOINT SUPPORTING FRAME AND CLIP ASSEMBLY

[75] Inventors: Dorothy Connors, Orange; Robert D. Chapman, Mission Viejo; Robert J. Winkler; Timothy K. Winkler, both of Santa Ana, all of Calif.

[73] Assignee: Alpha Nova Engineering, Inc., Santa Ana, Calif.

[21] Appl. No.: 966,053

[22] Filed: Dec. 4, 1978

[51] Int. Cl.[2] ..... D06C 3/08; A44B 21/00; B44D 3/18

[52] U.S. Cl. ..... 38/102.5; 24/243 K; 38/102.91; 160/395

[58] Field of Search ..... 38/102–102.91; 24/243 K; 160/395

[56] References Cited

U.S. PATENT DOCUMENTS

| | | | |
|---|---|---|---|
| 2,074,475 | 3/1937 | Jesser | 24/243 K |
| 3,482,343 | 12/1969 | Hamu | 38/102.5 |
| 3,914,887 | 10/1975 | Newman | 38/102.8 |
| 3,949,500 | 4/1976 | Connors | 38/102.5 |
| 4,107,826 | 8/1978 | Tysdal | 24/343 K |

FOREIGN PATENT DOCUMENTS

| | | | |
|---|---|---|---|
| 1106465 | 5/1961 | Fed. Rep. of Germany | 160/395 |

*Primary Examiner*—Louis Rimrodt
*Attorney, Agent, or Firm*—William C. Babcock

[57] ABSTRACT

A manually adjustable open four-sided frame and a number of improved clips that cooperate to provide an assembly that removably and frictionally engages a sheet of fabric on which needlepoint or other decoration is being defined to maintain a desired portion of the sheet within the confines of the frame in a taut condition. The clips if desired may be of such structure as to positively as well as frictionally engage peripheral edge portions of the sheet material when the latter is supported in a taut condition on the frame.

7 Claims, 7 Drawing Figures

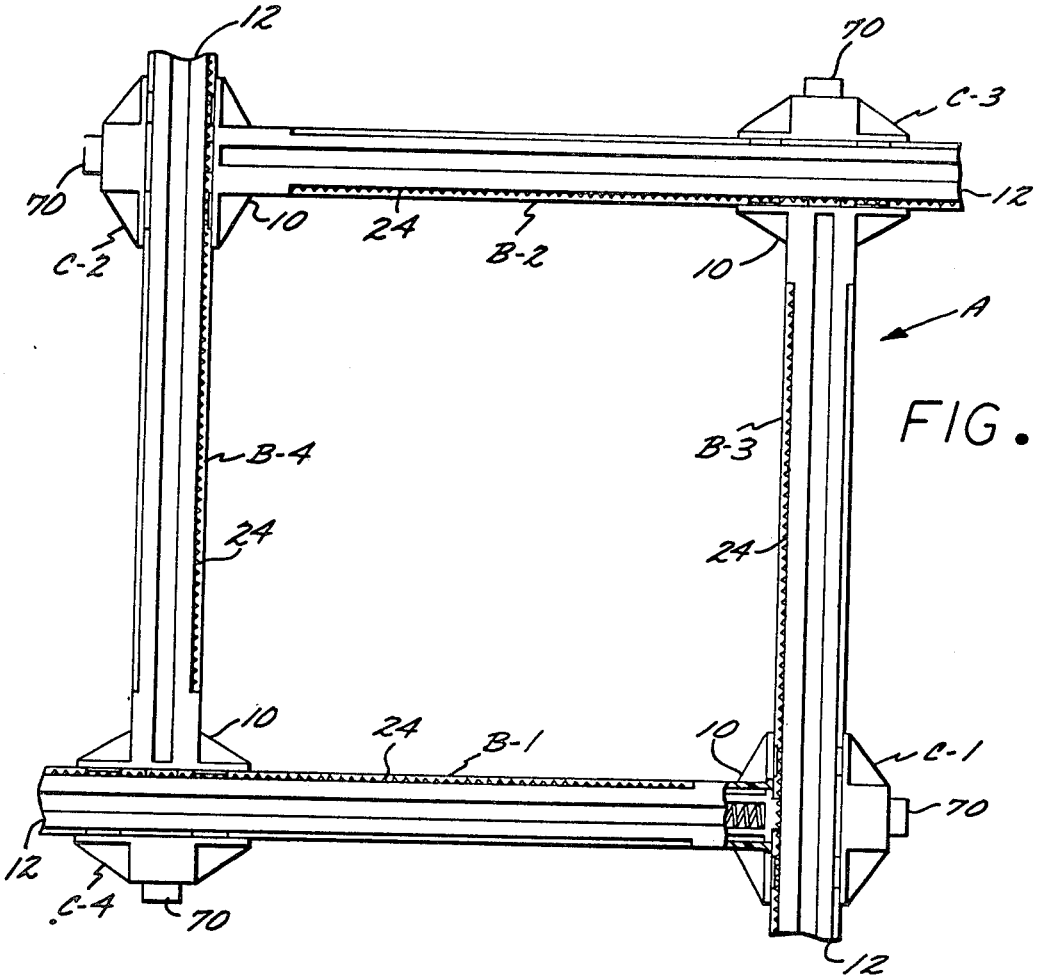
FIG. 4
FIG. 5
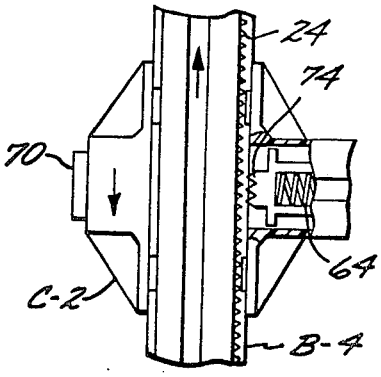
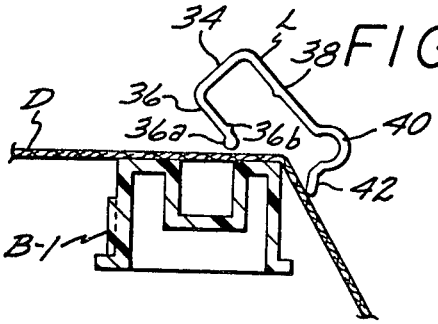
FIG. 6
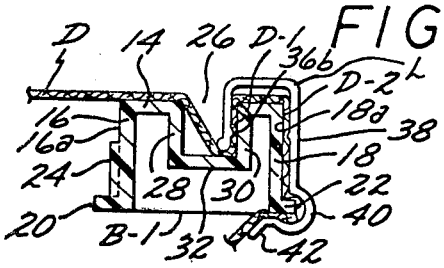
FIG. 7

NEEDLEPOINT SUPPORTING FRAME AND CLIP ASSEMBLY

BACKGROUND OF THE INVENTION

1. Field of the Invention

Needlepoint Supporting Frame and Clip Assembly.

2. Description of the Prior Art

In U.S. Pat. No. 3,949,500 issued to Dorothy Connors one of the co-inventors of the present invention, an adjustable needlepoint supporting frame is disclosed and claimed. The workpiece in the frame disclosed in the above-identified patent is supported by recess engaging elongate resilient bodies. From experience it has been found that such resilient bodies when disposed in recesses do not frictionally engage the needlepoint workpiece with a sufficient force to assure that the workpiece will at all times remain in a taut condition. Also, the frame of the prior above-identified patent limits the area of the needlepoint workpiece that may be supported within the confines thereof.

A major object of the present invention is to provide improved resilient clips that are easily mounted on a frame to assure that the needlepoint workpiece will remain in a taut position thereon, due either to frictional engagement therewith or frictional engagement in combination with positive engagement of the workpiece. The improved clips are not only easily mounted on the frame but are also easily removed therefrom.

Another object of the present invention is to supply an adjustable four-sided frame that is not only satisfactory for supporting needlepoint workpieces of normal size, but by the use of elongate extensions may be expanded to accommodate needlepoint workpieces of greater than normal size.

SUMMARY OF THE INVENTION

A needlepoint supporting frame defined by four elements, with each element including a lightweight elongate member having first and second ends, and each member having a longitudinal recess therein. Each first end of an elongate member supports a head on which a spring loaded locking member is disposed.

A number of improved resilient clips are provided that are easily mounted on the members when disposed in engagement with the recesses to so removably engage the needlepoint workpiece that it may not move appreciably relative to the frame, and the workpiece as a result remaining in a taut condition thereon. The present invention also includes four elongate extension members that removably interlock with second ends of the members to provide a frame that is capable of holding a needlepoint workpiece of extremely large size.

The elements when arranged in first and second normally disposed pairs, either with or without the extensions secured thereto, have the heads thereof adjustably held in interlocking relationship with the elongate members most adjacently disposed thereto, and the first and second pairs of elements defining a four sided frame.

The spring-loaded locking members of the first and second pairs of elements are diagonally disposed to one another. By manually manipulating the spring-loaded fastening members of the first pair the width of the frame may be expanded or contracted to conform to the width of the particular sheet of fabric on which needlepoint work is being performed and which sheet is designed to be held in the frame. When the spring-loaded fastening members of the second pair are similarly manipulated, the length of the frame may be expanded or contracted. The four elongate members have improved resilient clips removably mounted thereon that frictionally engage the peripheral edge portions of the needlepoint workpiece after the frame has been adjusted to accommodate the size of the workpiece. When the frame is not in use, it may be taken apart without the use of hand tools and the element comprising the frame, together with the extensions, stored side-by-side in parallel relationship to occupy a minimum of space. The elements, as well as the extensions, are preferably formed from a polymerized resin by conventional moulding techniques. The improved resilient clips are preferably formed by shaping individual sheets of metallic resilient material to the clip configuration that will subsequently be described in detail.

BRIEF DESCRIPTION OF THE DRAWING

FIG. 4 is a top plan view of the needlepoint supporting frame that may be manually adjusted to the desired width and length to accommodate a needlepoint workpiece that is removably secured thereto by recess engaging clips;

FIG. 5 is a fragmentary top plan view of the head portion of one of the elongate members;

FIG. 6 is an end elevational view of one of the resilient clips prior to the latter being mounted on one of the elongate members to removably and frictionally engage a peripheral edge portion of the needlepoint workpiece; and FIG. 7 is the same view as shown in FIG. 6, but with the resilient clip removably mounted on the elongate member to engage a peripheral edge portion of the needlepoint workpiece and prevent the latter moving relative to the frame.

DESCRIPTION OF THE PREFERRED EMBODIMENT

The adjustable needlepoint supporting frame A as shown in FIG. 4 includes first, second, third and fourth elongate members B-1, B-2, B-3 and B-4 that are identical in structure, and each of which has a first end 10 and second end portion 12. First, second, third and fourth heads C-1, C-2, C-3 and C-4 are provided that are of identical structure and are preferably formed as integral parts of the first, second, third and fourth elongate members B-1, B-2, B-3 and B-4 on first ends 10 thereof, as may be seen in FIG. 4.

The first, second, third and fourth heads C-1, C-2, C-3 and C-4 are of identical structure, and accordingly only the structure of the first head C-1 will be described in detail. The elongate members B-1, B-2, B-3 and B-4 are also identical in structure and accordingly only the elongate member B-1 will be described in detail.

Figure 1:
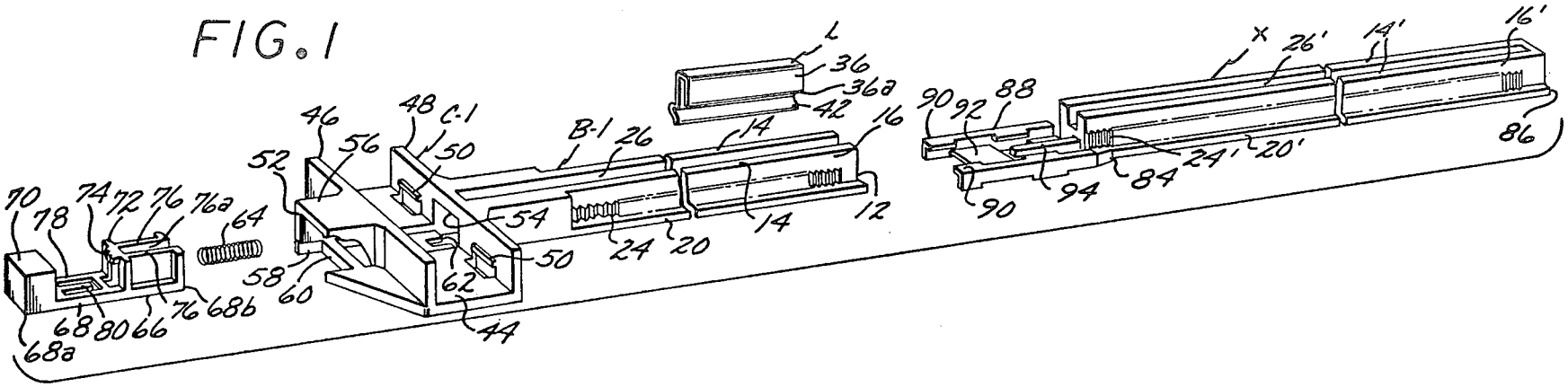
FIG. 1 is an exploded perspective view of one of the elements that comprise the needlepoint supporting frame, together with an extension thereof, which element includes an elongate member having first and second ends, a head mounted on a first end of the elongate member, and a fastening member and spring used in holding the fastening member in position on the head.

The elongate member B-1 which is also true of the elongate members B-2, B-3 and B-4, has an elongate web 14 that has first and second flanges 16 and 18 projecting outwardly from the longitudinal edges thereof in the same direction. The first flange has an external surface 16*a* as may be seen in FIG. 6, and the second flange 18 also has an external surface 18*a* as may be seen in the above-mentioned figure. The first and second flanges 16 and 18 have first and second lips 20 and 22 projecting outwardly from the free edges thereof as shown in FIGS. 6 and 7. An elongate toothed rack 24 is defined on the external surface 16*a* of the first flange 16 as shown in FIGS. 1, 6 and 7.

The elongate member B-1 as shown in FIGS. 1, 2, 6 and 7, has a longitudinally extending recess 26 defined in the web 14, which recess is provided by first and second side walls 28 and 30 that extend from the web in the same direction as the first and second flanges 16 and 18, and the first and second side walls having a bottom defining cross piece 32 connecting the free edges thereof.

The improved resilient clip L is shown in FIGS. 6 and 7, wherein it will be seen that it includes an elongate longitudinal member 34 that has a first side member 36 projecting from a longitudinal edge thereof, with the side member terminating on the free edge thereof in a bead 36*a*. A second side member 38 extends outwardly from the opposite longitudinal side of the longitudinal member 34 in the same direction as the first side member 36, but with the second side member being of greater depth than the first side member. The first side member 36 preferably has a protuberance 36*b* extending outwardly therefrom towards the second side member 38.

In FIGS. 6 and 7 it will be seen that when a peripheral edge portion of a sheet of pliable material D that is extended over the elongate member B-1, and the clip L moves from the position shown in FIG. 6 to that illustrated in FIG. 7, a section D-1 of the fabric will be frictionally and positively engaged in the recess 26, and a second section D-2 will be frictionally gripped between the exterior surface 18*a* of the second flange 18, the lip 22, and the interior surfaces of the second side member 38 and the semi-circular edge portion 40. The clip L is initially angularly positioned as shown in FIG. 6 and then pressed downwardly with a turning motion to dispose the clip in engagement with the elongate member B-1 as shown in FIG. 7. The clip L is disengaged from the elongate member B-1 by the trigger 42 being manually engaged, and the direction of pivoting of the clip L reversed to dispose it in an angular position relative to the elongate member B-1 where it may be lifted from the recess 26 to the position shown in FIG. 6. The clip L is formed from a single sheet of resilient sheet material, preferably a metallic material, and the sheet being shaped to define the clip as shown in FIGS. 6 and 7.

Each of elongate members of which B-1 is an example has a head E on the first end 10 thereof. The head E includes an elongate web 44, which web is normally disposed to the elongate member B-1. First and second side pieces 46 and 48 that are laterally spaced from one another extend outwardly from the web 44 as shown in FIG. 1. The side pieces 46 and 48 of their interior adjacent surfaces have pairs of ribs 50, formed thereon, which ribs slidably engage lips 20 and 22 of the elongate member disposed within the confines of the head E. First and second openings 52 and 54 are formed in the first and second side pieces 46 and 48 and are axially aligned with the elongate member B-1. A channel-shaped member 56, that is inverted as viewed in FIG. 1, extends outwardly from the first side piece 46 and is axially aligned with the first opening 52. The portion of the web 44 within the confines of the channel shaped member 56 is cut away to define a transverse cross piece 60 as shown in FIG. 1. The opening 54 has a longitudinally extending prong 62 situated within the confines thereof which prong extends towards the first side piece 46. The prong 62 has a helical spring 64 mounted thereon.

Figure 2:
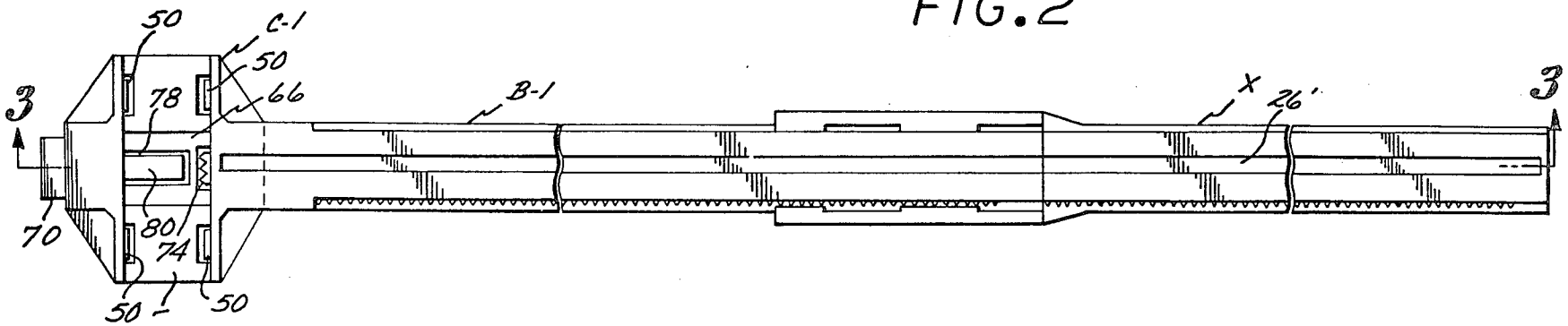
FIG. 2 is a top plan view of the elongate member and head shown in FIG. 1, together with the extension in removable engagement with the second end of the elongate member and illustrating an elongate recess that extends longitudinally on both the elongate member and extensions, which recess is adapted to be removably engaged by portions of the improved resilient clips shown in structural detail in FIGS. 6 and 7.
Figure 3:
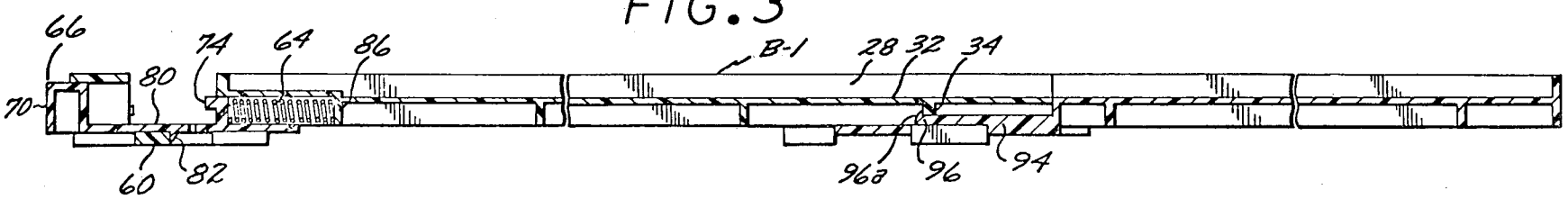
FIG. 3 is a side elevational view of the elongate member and extension removably engaged and axially aligned.

A manually actuatable locking member 66 is provided as may be seen in FIG. 1 that includes a rectangular plate 68 of such width as to be slidable within the first and second openings 62 and 64, and the plate 68 having a first end 68*a* and second end 68*b*. An actuating button 70 projects upwardly from the first end 68*a* of plate 68 as shown in FIG. 1. A cross member 72 extends upwardly from the plate 68 as may be seen in FIG. 1 and is intermediately disposed between the first and second ends 68*a* and 68*b* of the plate. The cross member 72 has a number of teeth 74 that extend outwardly therefrom towards the button 70 as may be seen in FIG. 1, and are of such height as to be engageable with the rack 24 of the elongate member that is disposed in the head E as shown in FIG. 2. Cross member 74 has reinforcing ribs 76 that extend longitudinally on the plate 68 from the member 72 to the second end 68*b* of the plate. The pair of reinforcing members 76 serve to define a longitudinally extending space 76*a* therebetween in which the spring 64 is disposed when mounted on the prong 62. A rectangular U-shaped slot 78 is formed in the plate 68 between the actuating button 70 and the cross member 72, with the slot serving to define a longitudinally extending tongue 80 that has a prong 82 projecting downwardly therefrom, which prong may be seen in FIG. 3. The locking member 66 is slidably movable in the openings 52 and 54 as shown in FIG. 3, with the locking member initially being moved inwardly the maximum amount to compress the spring 64 on the prong 62 with such movement causing the prong 82 to slide over the cross piece 60 and thereafter the prong 82 preventing inadvertent displacement of the locking member 66, due to the prong 80 abutting against the cross piece 60 as shown in FIG. 3. The cross piece 60 in cooperation with the stop 82 serves to limit the outward position of the locking member 66 relative to the head C-1 as shown in FIG. 1. In FIG. 4 it will be seen that the head C-1 is adjustably mounted on the elongate member B-3. By pressing the button 70 inwardly, the head C-1 may be moved longitudinally relative to the elongate member B-3 due to the teeth 74 being moved forwardly out of engagement with the rack 24 on the elongate member B-3. The first elongate member B-1 as may be seen in FIG. 3 also has a second cross member adjacent the first end 10 thereof, which cross member 86 supports the prong 62.

Four elongate extension members X are provided, one of which is shown in perspective in FIG. 1. Each of the extensions X includes a first end 84 and second end 86. The transverse cross section of each extension X between the first and second ends 84 and 86 thereof is identical to the structure of the elongate members B-1 between the head C-1 and second end 12. Elements defining the portion of the extension member X that is identical to the portion of the elongate member B-1 above-identified, has the elements thereof identified by the same numerals previously used in connection with the elongate member, but with primes being added thereto.

Each extension member X has a connector 88 projecting from the first end 84 thereof, and the connector being axially aligned with the extension member.

The connector 88 as may best be seen in FIG. 1 is formed as an integral part of an extension member X which connector includes a pair of laterally spaced elongate members of inverted L-shaped transverse cross section that project forwardly from the first end 84 of the extension member. The pair of elongate elements 90 have a reinforcing cross member extending therebetween. An elongate locking element 94 is axially aligned with the extension member X and projects forwardly from the first end 10 thereof, and terminates rearwardly of the reinforcing cross member 92. The locking member 94 on the forward end has an upwardly extending protuberance, which protuberance has a forward surface 96 that curves upwardly and rearwardly. From the above description it will be seen that the frame A as shown in FIG. 4 may be substantially enlarged by causing the extension members X to be removably secured to the first, second, third and fourth elongate members B-1, B-2, B-3 and B-4.

The use and operation of the frame A is extremely simple. When the first, second, third and fourth elongate members B-1, B-2, B-3 and B-4 are shown as disposed in FIG. 4 the first, second, third and fourth heads C-1, C-2, C-3 and C-4 have the locking members 66 thereof in engagement with racks 24. The first pair of elongate members B-1 and B-2 may be moved towards or away from one another by concurrently pressing inwardly on the locking members 66 associated with the first and second heads C-1 and C-2. Inward movement of the two locking members 66 associated with the first and second heads C-1 and C-2 result in separation of the teeth 74 from the rack 26. First head C-1 and elongate member B-1 can now move longitudinally relative to third elongate member B-3, as fourth elongate member B-4 and fourth head C-4 move longitudinally relative to second head C-2.

Thus, the width of the needlepoint supporting frame A may be varied to a size to accommodate the sheet D on which the needlepoint work is being performed. By pressing inwardly on the locking members 66 a second pair of the elongate members B-3 and B-4 may be moved longitudinally relative to the elongate members B-1 and B-2 to lengthen the frame A to a desired degree. When it is desired to enlarge the frame A beyond the size shown in FIG. 4, the elongate members B-1, B-2, B-3 and B-4 have extensions X mounted on the second ends thereof as previously explained, with the heads C-1, C-2, C-3, and C-4 then being mounted on the extension. The frame A operates in the same manner as previously described when the extensions X are utilized as a part thereof.

The elongate members B-1, B-2, B-3 and B-4 as well as extension members X have longitudinal recesses 26 defined therein that are adapted to be removably engaged by the clips L. When the frame A has been adjusted to a desired size, either with or without the extension members X, peripheral edge portions of the sheet D have sections D-1 held in the recesses 26 by the clip L as shown in FIG. 7, and also sections D-2 of the sheet resiliently gripped between the clip L and elongate members as shown in FIG. 7. After the needlepoint work has been completed on the sheet D, the clips are manually pivoted from the positions shown in FIG. 7 to that shown in FIG. 6 to disengage the clip L from the sheet, with the sheet thereafter being removed from the frame A. The frame A may now be taken apart, and the components that comprise the same including the extension members X stored side-by-side in compact parallel relationship until again needed.

The use and operation of the present invention has been described previously in detail, and need not again be repeated.

What is claimed is:

1. A resilient clip for use in removably securing a pliable sheet to an elongate member that has two laterally spaced parallel side surfaces, a connecting surface, a recess that extends inwardly from said connecting surface said recess defined by a pair of laterally spaced side walls and a bottom, and two lips that extend outwardly from the free edges of said side surfaces when a peripheral edge portion of said sheet extends over said connecting surface and over one of said side surfaces and lips, said clip being formed from a single sheet of resilient material that has been shaped to define:

a. a longitudinal member that has first and second laterally spaced parallel members;

b. a first side member that extends outwardly from said first member to terminate in a free edge in the form of a bead; and c. a second side member that extends outwardly from said second edge in the same direction as said first side member but of greater depth than the latter, said second side member having a free edge portion that has a substantially semi-circular transverse cross section, and the latter including a projecting trigger, with said clip when manually forced towards said peripheral edge portion of said sheet and elongate member having said first side member enter said recess to frictionally grip a first section of said peripheral edge portion between said bead and bottom and between said first side member and one of said side walls, and a second section of said peripheral edge portion frictionally gripped between one of said side surfaces, one of said lips, and said second side member and free edge portion of semi-circular cross section most adjacent thereto, and said peripheral edge portion of said sheet being released from said frame when manual force is applied to said trigger to pivot said clip in a direction that said second section of said sheet is first released from frictional engagement with said clip and said clip is thereafter pivoted transversely relative to said elongate member to the extent said first side member may be removed from said recess and from frictional engagement with said first section of said peripheral edge portion of said sheet.

2. A clip as defined in claim 1 which in addition includes:

d. a protuberance that projects from said first side member towards said side wall most adjacent thereto, said protuberance intermediately positioned between said bead and said longitudinal member, and said protuberance interlocking with said first section of said peripheral edge portion of said sheet.

3. In combination with a hollow frame defined by four elongate connected members that are normally disposed to one another at their connections, a plurality of clips for removably engaging said members and a sheet of pliable material to hold the latter positively in a taut position on said frame, each of said members having first and second ends, and a longitudinal portion of each of said members intermediate said first and second ends having a transverse cross-section defined by an elongate web that has first and second parallel flanges projecting from first and second longitudinal edges thereof, a lip that extends outwardly from a free longitudinal edge of said second flange, a longitudinal recess in said web intermediate said first and second edges thereof that is defined by first and second laterally spaced side walls that project from said web in the same direction as said first and second flanges and a cross piece that extends between said first and second side walls a substantial distance from said web, and each of said clips being formed from a rectangular sheet of a resilient material that has been shaped to define:

a. a longitudinal member that has first and second parallel side member;

b. a first normally disposed side member that extends from said first side members of said longitudinal member and has first and second sides and a longitudinally extending free edge, a longitudinal bead on said free edge, and a protuberance that projects from said second side of said first side member intermediate said bead and longitudinal member; and c. a second normally disposed side member that extends from said second member, said second side member having a free edge portion that has a transverse semi-circular section that develops into a trigger, said clip capable of removably securing a peripheral edge portion of said sheet to said frame when said peripheral edge portion of said sheet is positioned to extend over said recess and project downwardly beyond said lip on said second flange, said peripheral edge portion being secured to said frame when said clip is moved towards said frame to force a first section of said peripheral edge portion of said sheet into said recess to be frictionally gripped between said bead and cross piece and between said protuberance and second side wall and a second section of said material to be frictionally gripped between said second flange and second side member and between said lip and said semi circular section of said free edge portion of said second side member, and said peripheral edge portion of said sheet being released from said frame when said trigger is manually engaged and used to pivot said clip transversely relative to said elongate member to a position where said semi-circular section and second side member are separated from said lip and second flange and said first side wall and bead may be lifted from said recess.

4. The combination as defined in claim 3 in which each of said elongate members has first and second ends, and said combination in addition including:

d. first means on each of said first ends for slidably and adjustably engaging the one of said elongate members most adjacent thereto to permit said frame to be adjusted to a desired size.

5. The combination as defined in claim 4 which in addition includes:

e. four elongate extension members that have first and second ends, and the transverse cross-section between said first and second ends being substantially the same as that of said elongate members; and f. second means projecting from said first ends of said extension members for removably engaging said second ends of said elongate members and holding each of said extension members in axial alignment with one of said elongate members, and said first means capable of slidably and adjustably engaging said extension members to provide a needlepoint work piece supporting frame of greater size than when only said elongate members are used to define said frame.

6. The combination as defined in claim 5 in which each of said elongate members has a pair of longitudinally extending laterally spaced lips that extend outwardly therefrom, and each of said second means being a connector that extends outwardly from a first end of one of said extension members and slidably engages said pair of lips on said elongate member with which said extension member is associated.

7. The combination as defined in claim 6 in which each of said connectors includes a resilient locking member that removably engages a transverse portion of said elongate member with which it is associated to prevent inadvertent separation of said elongate member and extension member.

* * * * *